US005474155A

United States Patent [19]

Veidl et al.

[11] Patent Number: 5,474,155

[45] Date of Patent: Dec. 12, 1995

[54] BRAKE INSTALLATION FOR RAILBORNE VEHICLES

[75] Inventors: Peter Veidl, Vienna; Hans Hodl, Graz; Gerhard Neurorh, Nestelbach; Martin Teichmann, Graz; Gottfried Kubata, Murzzuschlag, all of Austria

[73] Assignee: SGP Verkehrstechnik Gesellschaft m.b.H., Vienna, Austria

[21] Appl. No.: 403,196

[22] Filed: Mar. 13, 1995

Related U.S. Application Data

[63] Continuation-in-part of Ser. No. 124,023, Sep. 21, 1993, abandoned.

[30] Foreign Application Priority Data

Sep. 21, 1992 [AT] Austria ..... 1877/92

[51] Int. Cl.[6] ..... B61H 13/00

[52] U.S. Cl. ..... 188/59; 188/71.5

[58] Field of Search ..... 188/58, 59, 33, 188/34, 71.5, 18 A, 218 XL; 74/665 F, 665 G; 105/96

[56] References Cited

U.S. PATENT DOCUMENTS

| | | | |
|---|---|---|---|
| 767,865 | 8/1904 | Brown | 188/58 |
| 1,987,419 | 1/1935 | Ross | 188/58 X |
| 4,498,562 | 2/1985 | Piepenbreier | 188/58 |
| 4,729,455 | 3/1988 | May | 188/58 |

FOREIGN PATENT DOCUMENTS

| | | |
|---|---|---|
| 0007021 | 1/1980 | European Pat. Off. . |
| 0118976 | 9/1984 | European Pat. Off. . |
| 0119690 | 9/1984 | European Pat. Off. . |
| 1806820 | 6/1970 | Germany . |
| 3047412 | 7/1982 | Germany . |
| 2135000 | 8/1984 | United Kingdom . |

*Primary Examiner*—Robert J. Oberleitner
*Assistant Examiner*—Lee W. Young
*Attorney, Agent, or Firm*—Jacobson, Price, Holman & Stern

[57] ABSTRACT

The invention relates to a brake installation for railborne vehicles comprising at least one wheel axle driven by a coupled motor-transmission unit in which the unit is connected by directly meshing gears for driving the wheel axle in a manner avoiding an intermediate gear, preferably by way of a hollow shaft concentrically enveloping the wheel axis. The wheel axle or the hollow shaft is connected to a disc brake shaft by directly meshing gears, without intermediate gears for transmitting a driving force to a disc brake provided on that side of the wheel axle which is opposite to the unit, wherein the brake disc is fitted on a brake shaft arranged parallel to the wheel set axle and to the motor shaft mounted on two sides to the motor-transmission unit.

10 Claims, 1 Drawing Sheet

BRAKE INSTALLATION FOR RAILBORNE VEHICLES

CROSS REFERENCE TO RELATED APPLICATION

This application is a continuation-in-part of U.S. Ser. No. 08/124,023 filed Sep. 21, 1993 for Brake Installation for Railborne Vehicles, now abandoned.

BACKGROUND OF THE INVENTION AND PRIOR ART

The invention relates to a brake installation for railborne vehicles comprising at least one wheel axle driven by a coupled motor-transmission unit in which the unit is connected by directly meshing gears to the wheel axle in a manner avoiding an intermediate gear, preferably by way of a hollow shaft concentrically enveloping this wheel axis and the wheel axle or the hollow shaft is connected for transmitting a driving force to a disc brake by directly meshing gears on the hollow shaft and a disc brake shaft provided on that side of the wheel axle which is opposite to the unit.

A construction is known for suburban coaches, having relatively low power and low mass, in which a pinion of the drive motor directly drives a gear on the wheel set shaft, whereby an intermediate gear which increases losses of engine power can be avoided. On that side of the wheel set which is opposite to the motor, a special power take-off is provided on the gear to which a floating brake disc is fitted. However, this method of mounting of a brake disc is not suitable for relatively high motor powers respectively relatively high vehicle weights because of the required increased brake capacity and the stressing of the mountings for the brake installations connected therewith.

For that reason, in the case of railborne vehicles having higher motor capacities and relatively high weight, the brake disc have been built onto the wheel axis respectively the hollow shaft surrounding the latter, involving the drawback, however, that the distance between the motor and the wheel axle must be increased in order to provide room for the brake discs, so that it is then necessary to provide an intermediate gear in the transmission which results in additional power loss. Moreover, in that case only relatively limited space is available for fitting the brake discs.

It is possible for a plurality of brake discs to be mounted on the brake shaft. In conjunction with the feature of the releasable bearing, it is also possible to provide a modular construction with a number of brake discs on the brake shaft which is variable depending on the intended purpose of use. The railborne vehicle equipped in accordance with the invention may be provided with whatever brake capacity is suitable for the purpose, the upper limits thereof depending solely on the available space on the brake shaft.

For that purpose it is possible on the one hand to interchange the entire brake shaft and replace it by another brake shaft having a different number of brake discs firmly mounted thereon. However, advantageously according to a further feature of the invention the brake discs are fitted to the brake shaft in a releasable manner so that in a less expensive manner it is possible to increase or decrease the brake capacity merely by additionally fitting or removing the desired number of brake discs.

According to a further feature of the invention the brake calipers as well are fitted to the motor-transmission unit. In this manner relative movements between the brake discs and the brake calipers are avoided so that a uniform application of the brake power and a design of simple construction is made available whilst avoiding floatingly mounted components.

These together with other objects and advantages which will become subsequently apparent reside in the details of construction and operation as more fully hereinafter described and claimed, reference being had to the accompanying drawings forming a part hereof, wherein like numerals refer to like parts throughout.

GENERAL DESCRIPTION OF THE INVENTION

Figure 1:
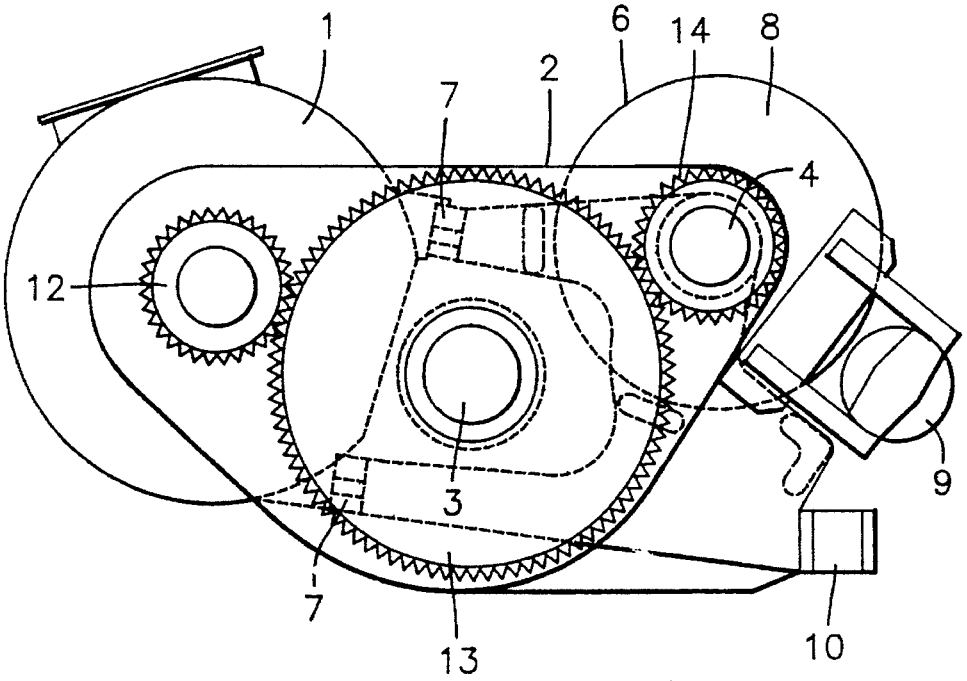
FIG. 1 a side elevation of a motor-transmission unit including a brake arrangement installation according to the invention, and FIG. 2 a plan view of the module according to FIG. 1 without the drive gears.
Figure 2:
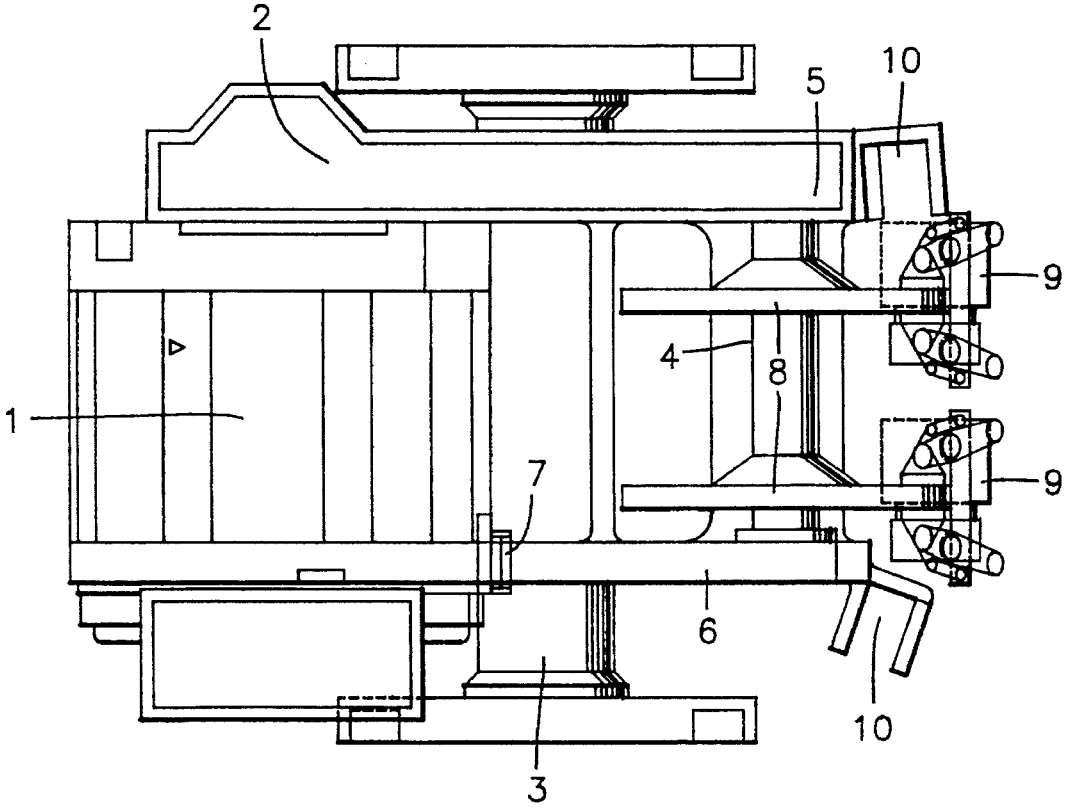

Accordingly, it was the object of the present invention to provide a brake installation suitable also for high motor power and high vehicle weight, having adequate brake capacity and wherein simultaneously the loss of motor power can be reduced to a minimum and wherein the available space in the region of the wheel axis is well utilized.

This object is attained in accordance with the invention in that the brake disc is fitted on a brake shaft arranged parallel to the wheel set axle and to the motor shaft and mounted on two sides to the motor-transmission unit. Due to the mounting of the brake shaft on two sides, a mechanically substantially more stable construction is attained which can accommodate a substantially higher brake capacity. At the same time, however, it remains possible to arrange the motor as close as possible to the wheel axle, thereby avoiding the intermediate gear in the transmission which would increase the power loss. This is of particular importance with motors having more than 1 MW cruising capacity, where even power losses or gains in a percentage range are of decisive importance.

The raising of the brake capacity rendered possible for the construction according to the invention also results in a reduction of the thermal and mechanical stressing of the wheels, because the employment of block brakes acting onto the wheels can be avoided.

According to a further feature of the invention, it is advantageous for a bearing of the brake shaft, preferably that bearing which is opposite to the driving connection to the wheel axle or the hollow shaft, to be releasable. This renders it easy to expose one end of the shaft in order to perform a brake disc replacement or to be able, if necessary, to remove the entire shaft in a simple manner.

DESCRIPTION OF SPECIFIC EMBODIMENT

The drive motor is denoted as 1 and typically supplies in modern, high capacity locomotives a cruising capacity of about 1,6 MW. A transmission 2 flange-connected thereto drives on the one hand a hollow shaft 3 through a drive pinion gear 12 on the drive motor 1 and a driven pinion gear 13 on the hollow shaft 3. The shaft 3 is connected in driving relationship to the wheel set axis (not illustrated). At the same time, however, also on that side which is opposite to the motor 1 with respect to the hollow shaft 3 a pinion gear 14 is in meshing engagement with pinion gear 13. The gear 14 is mounted on a brake shaft 4 in driving relationship. This arrangement provides a direct driving engagement between gears 12, 13 and 14 without any intermediate gears.

The brake shaft 4 is now mounted rotatively on the one side at 5 in the casing of the transmission 2 and at the opposite end in the front region 6 of a beam projecting from the motor 1.

As indicated at 7 by a flange connection, the front portion 6 of the beam is releasable and removable and thereby also the bearing which is opposite to the driving connection of the brake shaft to the hollow shaft 3. As a result the brake discs 8 provided on the brake shaft 4, if they are releasably fitted, can be readily removed respectively refitted to the brake shaft 4 or, where appropriate, the entire brake shaft 4 including the brake discs 8 provided thereon can be disconnected.

The brake calipers 9 acting onto the brake discs 8, in order to avoid relative movements, are advantageously likewise fitted to the motor-transmission unit 1, 2, but can also be fitted to the bogey chassis (not illustrated).

Although in the drawings, by way of example, two brake discs 8 are illustrated, their maximum number is limited in an upward direction only by the length of the brake shaft 4, whereas, even in the event of a single brake disc only, the brake capacity is clearly increased as compared with conventional constructions of a brake disc due to the mechanically substantially more stable two-sided mounting of the brake shaft 4.

An additional advantage results with the employment of the illustrated module in a dual axle power bogey, because due to the reduced distance between the motor 1 and the hollow shaft 3 within which the wheel set axle extends, a bogey can be attained having a clearly reduced axle spacing, which due to this short wheel base provides a clearly improved curve going ability.

The increased space requirement on that side of the hollow shaft 3 which is opposite to the motor 1 is of no importance, because that space in conventional bogeys is largely unutilized.

The regions of the casing for the transmission respectively of the front portion 6 of the beam on the side which is opposite to the casing of the transmission 2, provided for the accommodation of the bearings of the brake shaft 4 may advantageously at the same time be utilized in conjunction with fitting means 10 for components for suspending the motor-transmission unit 1,2 together with the brake installation on the bogey chassis or also on the vehicle chassis.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A brake installation for railborne vehicles comprising at least one wheel axle with a gear thereon, said gear on the at least one wheel axle being directly meshed with and driven by a pinion gear of a coupled motor-transmission unit, said gear on said at least one wheel axle being directly meshed with a second gear mounted on a brake shaft arranged parallel to the at least one wheel axle and opposite the motor-transmission unit with respect to the at least one wheel axle, said brake shaft being provided with at least one brake disc and being mounted to the motor-transmission unit on both sides of the at least brake disc.

2. The installation as claimed in claim 1, wherein said at least on brake disc is fitted releasably on the brake shaft.

3. The installation as claimed in claim 1, wherein a plurality of brake discs are provided on said brake shaft.

4. The installation as claimed in claim 3, wherein said brake discs are releasably fitted on the brake shaft.

5. The installation as claimed in claim 3, wherein said brake shaft is mounted to the motor-transmission unit on both sides of all of said brake discs.

6. The installation as claimed in claim 1, wherein said brake shaft is releasable bearing.

7. The installation as claimed in claim 6, wherein the releasable bearing of the brake shaft is opposite to the second gear mounted on the brake shaft that is engaged with the gear on the wheel axle.

8. The installation as claimed in claim 1, wherein a brake caliper for the brake disc on the brake shaft is fitted to the motor-transmission unit.

9. The installation as claimed in claim 3, wherein brake calipers for each of said plurality of brake discs is fitted to the motor-transmission unit.

10. The installation as claimed in claim 1, wherein said at least one wheel axle is concentrically enveloped by a hollow shaft, said shaft being drivingly connected with said enveloped wheel axle and being provided with said gear thereon, said gear on the hollow shaft being driven by said pinion gear of said coupled motor-transmission unit and engaged with said second gear mount on said brake shaft arranged parallel to the hollow shaft and wheel axle and opposite the motor-transmission unit with respect to said wheel axle and hollow shaft, said brake shaft being provided with said at least one brake discs and being mounted to the motor transmission unit on both sides of said at least one brake disc.

* * * * *